US011280167B2

(12) United States Patent
Daly

(10) Patent No.: US 11,280,167 B2
(45) Date of Patent: Mar. 22, 2022

(54) PERFORATING GUN AND SYSTEM AND METHOD FOR USING THE SAME

(71) Applicant: Expro Americas LLC, Houston, TX (US)

(72) Inventor: Kerry G. Daly, Conroe, TX (US)

(73) Assignee: Expro Americas, LLC, Houston, TX (US)

( * ) Notice: Subject to any disclaimer, the term of this patent is extended or adjusted under 35 U.S.C. 154(b) by 0 days.

(21) Appl. No.: 16/943,503

(22) Filed: Jul. 30, 2020

(65) Prior Publication Data

US 2021/0032962 A1 Feb. 4, 2021

Related U.S. Application Data

(60) Provisional application No. 62/880,747, filed on Jul. 31, 2019.

(51) Int. Cl.
*E21B 43/117* (2006.01)
*E21B 43/119* (2006.01)

(52) U.S. Cl.
CPC ..... *E21B 43/119* (2013.01); *E21B 43/117* (2013.01)

(58) Field of Classification Search
CPC ... E21B 43/117; E21B 43/119; E21B 43/1185
See application file for complete search history.

(56) References Cited

U.S. PATENT DOCUMENTS

| | | | | |
|---|---|---|---|---|
| 5,287,924 | A | 2/1994 | Burleson | |
| 6,536,524 | B1 | 3/2003 | Snider | |
| 2008/0053658 | A1* | 3/2008 | Wesson | E21B 43/114 166/297 |
| 2010/0000789 | A1 | 1/2010 | Barton | |
| 2014/0151037 | A1* | 6/2014 | Morgan-Smith | E21B 43/12 166/255.2 |
| 2015/0075770 | A1* | 3/2015 | Fripp | F42D 1/045 166/65.1 |
| 2017/0009563 | A1* | 1/2017 | Holder | E21B 43/263 |
| 2018/0274342 | A1* | 9/2018 | Sites | E21B 43/117 |
| 2020/0199957 | A1* | 6/2020 | Bertoja | E21B 23/00 |
| 2020/0225014 | A1 | 7/2020 | Maxted | |
| 2021/0032962 | A1* | 2/2021 | Daly | E21B 43/1185 |

FOREIGN PATENT DOCUMENTS

| | | | | |
|---|---|---|---|---|
| CN | 106837265 A | * | 6/2017 | |
| CN | 106837265 A | | 6/2017 | |
| GB | 2544247 A | * | 5/2017 | E21B 43/1185 |
| WO | WO-0220939 A1 | * | 3/2002 | E21B 23/00 |

OTHER PUBLICATIONS

Partial International Search Report for PCT/US2020/044227 dated Oct. 8, 2020.

* cited by examiner

*Primary Examiner* — Daniel P Stephenson
(74) *Attorney, Agent, or Firm* — Getz Balich LLC

(57) ABSTRACT

A perforating gun system for use in a well casing disposed within a subterranean well includes a plurality of perforating gun sections each having at least one shaped charge. The plurality of perforating gun sections includes an initial perforating gun section and at least one secondary perforating gun section having an activator and a sensor configured to sense an actuation of another of the plurality of perforating gun sections. The sensor is further configured to cooperate with the activator to actuate the at least one secondary perforating gun section upon sensing the actuation of the another of the plurality of perforating gun sections.

17 Claims, 6 Drawing Sheets

PERFORATING GUN AND SYSTEM AND METHOD FOR USING THE SAME

This application claims priority to U.S. Patent Application No. 62/880,747, filed Jul. 31, 2019, which is herein incorporated by reference in its entirety.

BACKGROUND

1. Technical Field

The present disclosure relates to perforating guns, and apparatus and method for operating perforating guns within a subterranean well.

2. Background Information

Subterranean wells (subsea or land based) are typically created by drilling a hole into the earth with a drilling rig. After the hole is drilled, well casing sections are inserted into the hole to provide structural integrity to the newly drilled wellbore. This process may be repeated several times at increasingly smaller bore diameters to create a well at a desired depth. Hydrocarbons, such as oil and gas, are produced from the well casing that intersects with one or more hydrocarbon reservoirs in a formation. The hydrocarbons flow into the well casing through perforations in the well casing.

A perforating gun loaded with shaped charges may be used to create perforations in a well casing. The gun may be lowered into the wellbore on electric wireline, slickline, tubing, coiled tubing, or other conveyance device until it is adjacent the hydrocarbon producing formation. Thereafter, prior art systems may employ a signal from the well head to actuate a firing head associated with the perforating gun, which then causes actuation of the shaped charges. Projectiles or jets formed by the explosion of the shaped charges penetrate the well casing to thereby allow formation fluids to flow through the perforations and into the well casing.

In wells that have long or substantial gaps between production zones, the efficiency and cost of perforating the production zones must be considered. In some instances, a plurality of well casing sections, each aligned with a respective production zone, may be separately perforated by inserting a perforating gun into the well multiple times; e.g., by running a work string in and out of the well for each zone to be perforated. This approach often increases rig and personnel time and can be costly. In other instances, a perforating gun assembly that includes a plurality of independent perforating guns may be inserted into the well casing. The perforating gun assembly is a continuous system configured with the perforating guns separated from one another by blank guns. The blank guns typically contain explosive boosters and explosive detonating cord configured to propagate an explosive train from one perforating gun to the next. Blank guns are not operable to perforate well casing. The perforating gun spacing within the assembly is chosen so that each perforating gun is aligned with a production zone. There are several drawbacks to such perforating gun assemblies. For example, in some wellbores, the entire perforating gun assembly can extend several thousands of feet long, with only a few perforating gun sections spaced between very long blank gun sections. Since blank gun sections are typically made with the same equipment as the perforating gun sections, these blank gun sections tend to be expensive and are often length limited. In addition, at every connection between adjacent blank gun sections, there is the risk that the propagation of the explosive train will cease (sometime referred to as a "stop-fire"), so it is desirable to reduce the number of connections between blank guns sections, or the use of blank guns at all, if possible.

SUMMARY

It should be understood that any or all of the features or embodiments described herein can be used or combined in any combination with each and every other feature or embodiment described herein unless expressly noted otherwise.

According to an aspect of the present disclosure, a perforating gun system for use in a well casing disposed within a subterranean well includes a plurality of perforating gun sections each having at least one shaped charge. The plurality of perforating gun sections includes an initial perforating gun section and at least one secondary perforating gun section having an activator and a sensor configured to sense an actuation of another of the plurality of perforating gun sections. The sensor is further configured to cooperate with the activator to actuate the at least one secondary perforating gun section upon sensing the actuation of the another of the plurality of perforating gun sections.

In any of the aspects or embodiments described above and herein, the initial perforating gun section is actuable via external impetus.

In any of the aspects or embodiments described above and herein, the initial perforating gun section is selectively configurable between an enabled condition in which the initial perforating gun section is actuable via external impetus and a disabled condition.

In any of the aspects or embodiments described above and herein, the at least one secondary perforating gun section includes a time delay mechanism with a signal path between the sensor and the activator and configured to delay the actuation of the at least one secondary perforating gun section.

In any of the aspects or embodiments described above and herein, the initial perforating gun section is configured to produce an identifier upon actuation which is unique to the initial perforating gun section.

In any of the aspects or embodiments described above and herein, the at least one secondary perforating gun section includes a first secondary perforating gun section and the first secondary perforating gun section is configured to actuate upon receipt of the unique identifier of the initial perforating gun section.

In any of the aspects or embodiments described above and herein, the first secondary perforating gun section is configured to produce a second identifier upon actuation which is unique to the first secondary perforating gun section and different than the unique identifier of the initial perforating gun section. The at least one secondary perforating gun section further includes a second secondary perforating gun section and the second secondary perforating gun section is configured to actuate upon receipt of the unique second identifier of the first secondary perforating gun section.

In any of the aspects or embodiments described above and herein, the at least one secondary perforating gun section is configured to count a number of perforating gun section actuations and to actuate when the counted number of perforating gun section actuations equals a predetermined number of perforating gun section actuations.

In any of the aspects or embodiments described above and herein, the sensor configured to sense the actuation of the another of the plurality of perforating gun sections is further configured to sense for at least one of a shock wave, a pressure pulse, an EM wave, or an acoustic signal directly produced by the actuation of the another of the plurality of perforating gun sections.

According to another aspect of the present disclosure, a perforating gun system for use in a well casing disposed within a subterranean well includes a plurality of perforating gun sections each having at least one shaped charge. The plurality of perforating gun sections includes a first perforating gun section having at least one RFID pig and an RFID pig release mechanism. The RFID pig release mechanism is configured to release the at least one RFID pig upon actuation of the first perforating gun section. The plurality of perforating gun sections further includes at least one secondary perforating gun section having an activator and an RFID reader. The RFID reader is configured to read information from the at least one RFID pig. The RFID reader is further configured to cooperate with the activator to actuate the secondary perforating gun section upon reading the information from the at least one RFID pig.

In any of the aspects or embodiments described above and herein, the at least one secondary perforating gun section is located gravitationally adjacent the first perforating gun section.

In any of the aspects or embodiments described above and herein, the at least one RFID pig is configured to float within a fluid of the subterranean well.

In any of the aspects or embodiments described above and herein, the at least one RFID pig is configured to sink within a fluid of the subterranean well.

In any of the aspects or embodiments described above and herein, the at least one secondary perforating gun section includes at least one secondary RFID pig and a secondary RFID pig release mechanism configured to release the at least one secondary RFID pig.

In any of the aspects or embodiments described above and herein, the secondary RFID pig release mechanism is configured to release the at least one secondary RFID pig upon actuation of the at least one secondary perforating gun section.

In any of the aspects or embodiments described above and herein, the first perforating gun section further includes a sensor configured to sense an actuation of another of the plurality of perforating gun sections. The sensor is further configured to cooperate with the RFID pig release mechanism to cause the RFID pig release mechanism to release the at least one RFID pig upon actuation of the another of the plurality of perforating gun sections.

According to another embodiment of the present disclosure, a method for actuating a plurality of perforating gun sections of a perforating gun system for a subterranean well includes inserting a work string having a plurality of perforating gun sections, each having at least one shaped charge, into a well casing disposed within the subterranean well. The plurality of perforating gun sections includes a first perforating gun section and at least one secondary perforating gun section having an activator and a sensor. The method further includes aligning the plurality of perforating gun sections with a respective plurality of production zones within the subterranean well. The method further includes actuating the plurality of perforating gun sections by actuating the first perforating gun section via external impetus such that a condition caused by actuation of the first perforating gun section is sensed by the sensor causing the activator to actuate the at least one secondary perforating gun section.

In any of the aspects or embodiments described above and herein, actuating the plurality of perforating gun sections includes sensing an actuation of another of the plurality of perforating gun sections, with the sensor, and actuating the at least one secondary perforating gun section upon sensing the actuation of the another of the plurality of perforating gun sections.

In any of the aspects or embodiments described above and herein, actuating the initial perforating gun section includes releasing at least one RFID pig with an RFID pig release mechanism of the first perforating gun section upon actuation of the first perforating gun section and reading information from the at least one RFID pig with an RFID reader of the at least one secondary perforating gun section and actuating the at least one secondary perforating gun section upon reading the information from the at least one RFID pig. The sensor of the at least one secondary perforating gun section includes the RFID reader.

In any of the aspects or embodiments described above and herein, the plurality of perforating gun sections of the work string has one of a top-down firing sequence or a bottom-up firing sequence.

The present disclosure, and all its aspects, embodiments and advantages associated therewith will become more readily apparent in view of the detailed description provided below, including the accompanying drawings.

DETAILED DESCRIPTION

Figure 1:
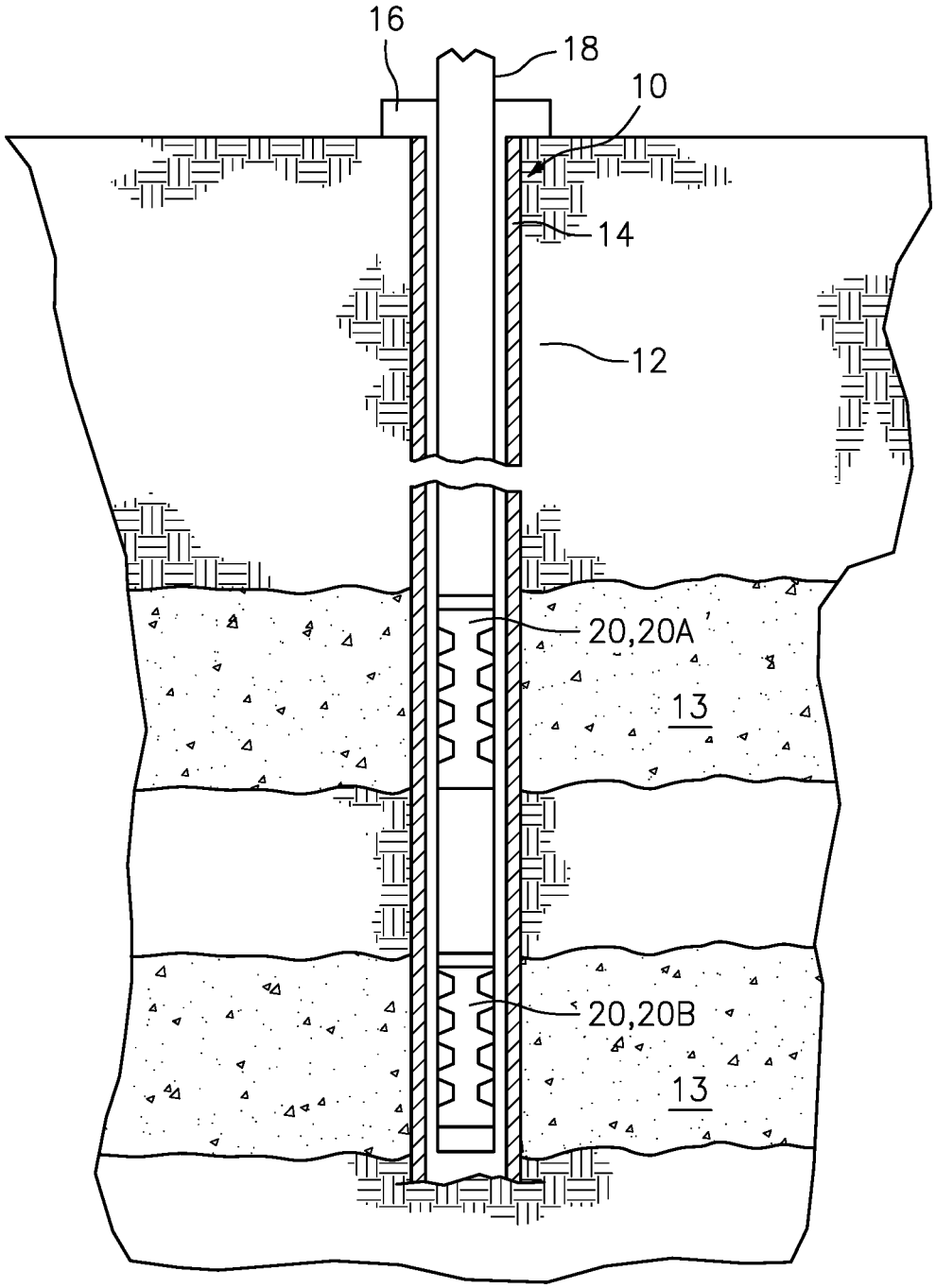
FIG. 1 is a diagrammatic illustration of a subterranean well, in accordance with one or more aspects of the present disclosure.
Figure 2:
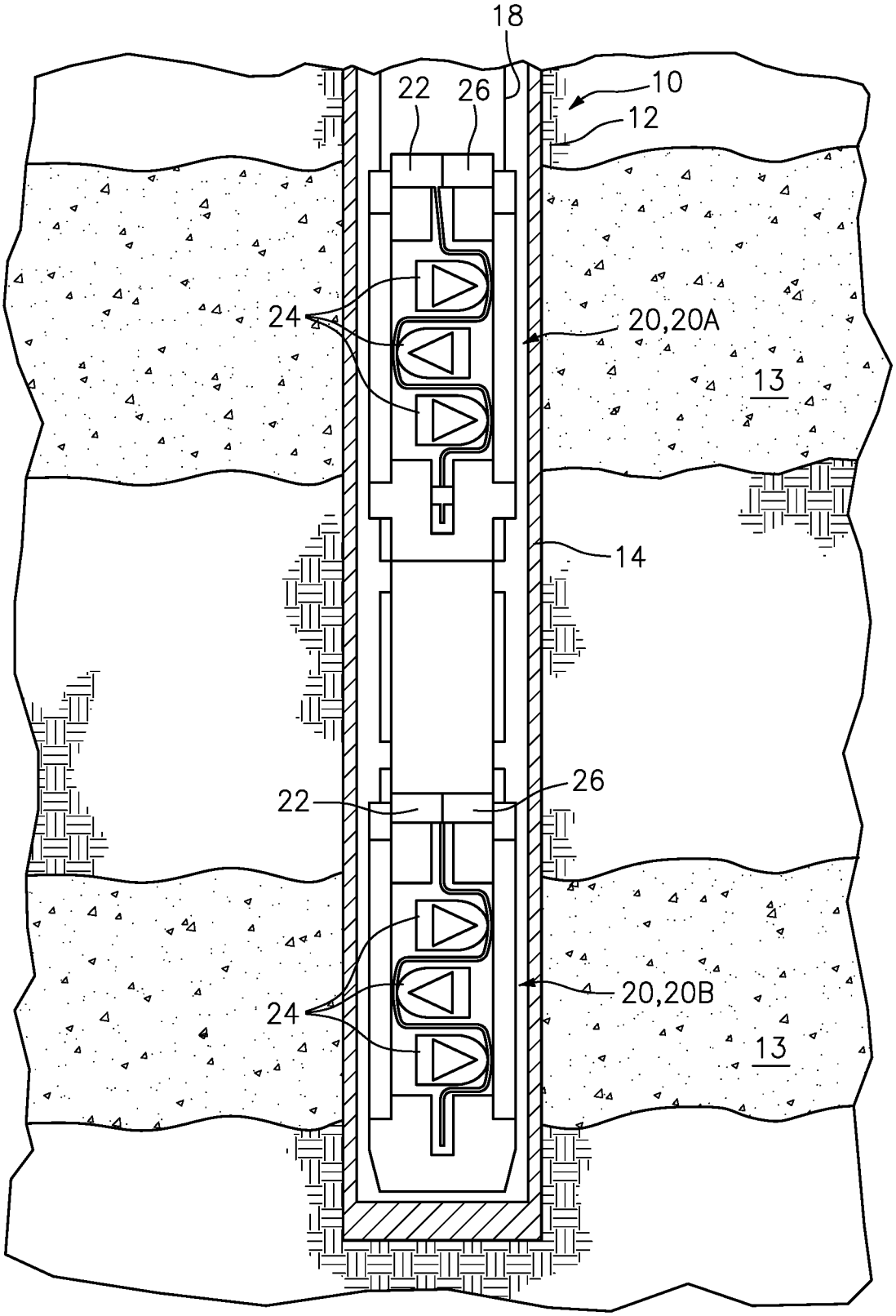
FIG. 2 is a diagrammatic illustration of a portion of a subterranean well, including perforating gun section embodiments, in accordance with one or more aspects of the present disclosure.

The present disclosure relates to devices and methods for actuating one or more downhole tools, such as but not limited to perforating guns. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Referring to FIGS. 1-3 and 5, a subterranean well is shown having a wellbore 10 that extends into a subterranean formation 12. The subterranean formation 12 includes one or more production zones 13. The subterranean well is shown as a land-based well, but the present disclosure is not limited thereto. The wellbore 10 includes a well casing 14 and a wellhead 16. A work string 18 may be used to suspend tooling within the well casing 14, and to convey the tooling into and out of the well casing 14. In addition to the tooling, the work string 18 may include tubing, drill pipe, wire line, slick line, or any other known conveyance means.

According to aspects of the present disclosure, the work string tooling includes a plurality of perforating gun sections 20 (i.e., an initial perforating gun section 20A and at least one secondary perforating gun section 20B), typically spaced apart from one another within the work string 18. The sections of the work string 18 disposed between perforating gun sections 20 are free of explosive material and/or detonator cord. Each perforating gun section 20 includes at least one activator 22 and at least one perforating shaped charge 24. The present disclosure is not limited to any particular perforating gun section 20 configuration other than as indicated herein; i.e., the present disclosure may be used with a variety of different perforating gun section 20 configurations.

The initial perforating gun section 20A may be actuable via an external impetus. The term "external impetus" as used herein refers to a signal or condition external to the initial perforating gun section 20A or not associated with the actuation of the initial perforating gun section 20A. Non-limiting examples of a signal or condition external to or not associated with the actuation of an initial perforating gun section 20A include a surface transmitted signal, a "drop bar," wellbore conditions such as pressure and/or temperature, timer-based actuation, etc. The present disclosure is not limited to any particular initial perforating gun section 20A configuration other than as specified herein.

Each secondary perforating gun section 20B includes an activator 22, at least one perforating shaped charge 24, and at least one sensor 26 (e.g., see FIG. 2) configured to sense a signal directly produced by the actuation of a perforating gun section 20 (e.g., a "condition" of a perforating gun section actuation). The signal directly produced by the actuation of a perforating gun section 20 may take a variety of different forms; e.g., a shock wave, a pressure pulse, a pressure wave, an electromagnetic wave (an "EM wave"), an acoustic signal, etc., and in some instances one or more combinations of the same. The present disclosure is not limited to sensing for any particular type of signal, provided the aforesaid signal is produced by the actuation of a perforating gun section 20. To be clear, the at least one sensor 26 and the activator 22 are components within the respective secondary perforating gun section 20B and are independent of any other perforating gun section 20 or work string 18 component disposed between perforating gun sections 20. The activator 22 may be configured to initiate a firing sequence for the respective secondary perforating gun section 20B upon receipt of a signal from the sensor 26.

In some embodiments, initial perforating gun sections 20A and secondary perforating gun sections 20B may be configured the same. For example, a perforating gun section may include an activator 22, at least one perforating shaped charge 24, at least one sensor 26, and is actuable via an external impetus. In these embodiments, the ability to be actuable via an external impetus can be selectively switched on or off or enabled or disabled. Such a perforating gun section may be utilized as either an initial perforating gun section or a secondary perforating gun section.

In some embodiments, one or more of the secondary perforating gun sections 20B may include a time delay mechanism (not shown). The time delay mechanism may, for example, be configured to be within a signal path between the sensor 26 and the activator 22 for the respective secondary perforating gun section 20B. The time delay mechanism may be configured to create a predetermined time interval between receipt of the sensor signal and providing a signal to the activator 22, thereby delaying the actuation of the secondary perforating gun section 20B by the predetermined time interval.

The at least one sensor 26 configured to sense a signal directly produced by the actuation of a perforating gun section 20 may assume a variety of different configurations; e.g., configured to sense a signal that is directly produced by the actuation of a perforating gun section 20 such as a shock wave, a pressure pulse, a pressure wave, an EM wave, an acoustic signal, etc., and any combination thereof. Sensing for a signal that is directly produced by the actuation of a perforating gun section 20 greatly simplifies the device and eliminates elements that could potentially lead to a malfunction (e.g., a "stop-fire"). The sensor 26 may be configured to sense the presence and magnitude of a respective signal type and to produce an output signal representative of the sensed signal. In these instances, the sensor output signal may be provided to a logic device (i.e., any type of computing device, computational circuit, process or processing circuit, etc.) capable of evaluating the sensor output signal relative to one or more predetermined parameters; e.g., logic that determines if a predetermined condition is met such as whether the magnitude or the frequency of the wave/signal meets the predetermined condition. Alternatively, the sensor 26 may be configured to sense the presence, magnitude and/or frequency of a respective signal type within the well environment and to only produce an output signal when the sensed signal meets a predetermined condition. The present disclosure is not limited to use with the exemplary sensor 26 configurations described above.

The following examples illustrate how differently configured sensors 26 may operate within a secondary perforated gun section 20B. Upon the actuation of a perforating gun section 20 (e.g., the initial perforating gun section 20A), high shock forces are produced within the wellbore 10 and are transmitted to fluid disposed within the wellbore 10. The shock forces produce shock waves. In a first embodiment, the sensor 26 of a secondary perforating gun 20B is configured to sense for shock waves. As indicated above, a variety of different sensor 26 configurations may be used. Also as stated above, the predetermined condition is based on a shock wave that can only be produced by actuation of a perforating gun section 20. Regardless of the sensor 26 configuration, when the sensed shock wave meets the predetermined condition, a signal is provided to the activator 22. The activator 22 will, in turn, produce an output that causes the respective secondary perforating gun section 20B to actuate. Depending on the configuration of the secondary perforating gun 20B, the activator 22 output may immediately cause the secondary perforating gun section 20B to actuate, or may cause the secondary perforating gun section 20B to actuate after a predetermined time interval if the gun section 20B includes a time delay mechanism.

In a second embodiment, the sensor 26 of a secondary perforating gun section may be configured to sense for pressure pulses. As indicated above, a variety of different sensor 26 configurations may be used; e.g., the pressure pulse sensor 26 may produce an output signal that is representative of the presence, magnitude, and/or frequency of the sensed pressure pulse, or may produce an output signal only when the sensed pressure pulse signal meets a predetermined condition, etc. The predetermined condition is based on a pressure pulse that can only be produced by actuation of a perforating gun section 20. Regardless of the sensor 26 configuration, when the sensed pressure pulse meets the predetermined condition, a signal is provided to the activator 22. The activator 22 will, in turn, produce an output that causes the respective secondary perforating gun section 20B to actuate immediately or after a time interval as described above.

In a third embodiment, the sensor 26 of a secondary perforating gun 20B is configured to sense for EM waves. As indicated above, a variety of different sensor 26 configurations may be used; e.g., the EM wave sensor 26 may produce an output signal that is representative of the presence, magnitude, and/or the frequency of the sensed EM wave, or may produce an output signal only when the sensed EM wave signal meets a predetermined condition, etc. The predetermined condition is based on an EM wave that can only be produced by actuation of a perforating gun section 20. Regardless of the sensor 26 configuration, when the sensed EM wave meets the predetermined condition, a signal is provided to the activator 22. The activator 22 will, in turn, produce an output that causes the respective secondary perforating gun section 20B to actuate immediately or after a time interval as described above.

In a fourth embodiment, the sensor 26 of a secondary perforating gun section 20B is configured to sense for acoustic waves. As indicated above, a variety of different sensor 26 configurations may be used; e.g., the acoustic wave sensor 26 may produce an output signal that is representative of the presence, magnitude, and/or frequency of the sensed acoustic wave, or may produce an output signal only when the sensed acoustic wave signal meets a predetermined condition, etc. The predetermined condition is based on an acoustic wave that can only be produced by actuation of a perforating gun section 20. Regardless of the sensor 26 configuration, when the sensed acoustic wave meets the predetermined condition, a signal is provided to the activator 22. The activator 22 will, in turn, produce an output that causes the respective secondary perforating gun section 20B to actuate immediately or after a time interval as described above.

In some embodiments of the present disclosure, perforating gun sections within a work string may be configured to facilitate a predetermined sequential operating order. The following description is a non-limiting example of a device configured for a predetermined sequential operating order. The actuation of an initial perforating gun section 20A as described above produces a signal as described above (e.g., a shock wave). That signal is either unique to the initial perforating gun section 20A or is accompanied by an identifier (e.g., a secondary signal that is unique to the initial perforating gun section). A first secondary perforating gun section is configured to determine the source of the signal(s); e.g., the initial perforating gun section unique identifier. Upon receipt and recognition of the unique identifier, the first secondary perforating gun section is actuated. Each secondary perforating gun section within the work string may be configured to actuate upon receipt of a predetermined unique identifier. Hence, in some embodiments only the first secondary perforating gun section may be configured to accept the unique identifier from the initial perforating gun section and thereby be actuated.

In similar fashion, once the first secondary perforating gun section is actuated, it produces a signal as described above (e.g., a shock wave), and that signal is either unique to the first secondary perforating gun section or is accompanied by an identifier unique to the first secondary perforating gun section. A second secondary perforating gun section is configured to determine the source of the signal(s) produced upon actuation of the first secondary perforating gun section. Upon receipt and recognition of the unique identifier from the first secondary perforating gun section, the second secondary perforating gun section is actuated. This exemplary process can be repeated a plurality of times depending on the number of perforating gun sections within the work string. The present disclosure is not limited to the above example. As another example, all secondary perforating gun sections could be configured to sense signals directly produced by actuation of a perforating gun section as described above. In addition, each secondary perforating gun section could be configured to "count" the number perforating gun section actuations. In this manner, the first secondary perforating gun section could be configured to actuate after sensing a single perforating gun section actuation (i.e., that of the initial perforating gun section), the second secondary perforating gun section could be configured to actuate when the counted number of perforating gun section actuations equals a predetermined number of perforating gun section actuations (e.g., one actuation or greater than one actuation). For example, after sensing two perforating gun section actuations (i.e., that of the initial perforating gun section and the first secondary perforating gun section), the second secondary perforating gun section could be configured to actuate. In various embodiments, the predetermined number of perforating gun section actuations required to actuate a particular perforating gun section of the plurality of perforating gun sections may be unique to that particular perforating gun section.

Figure 3:
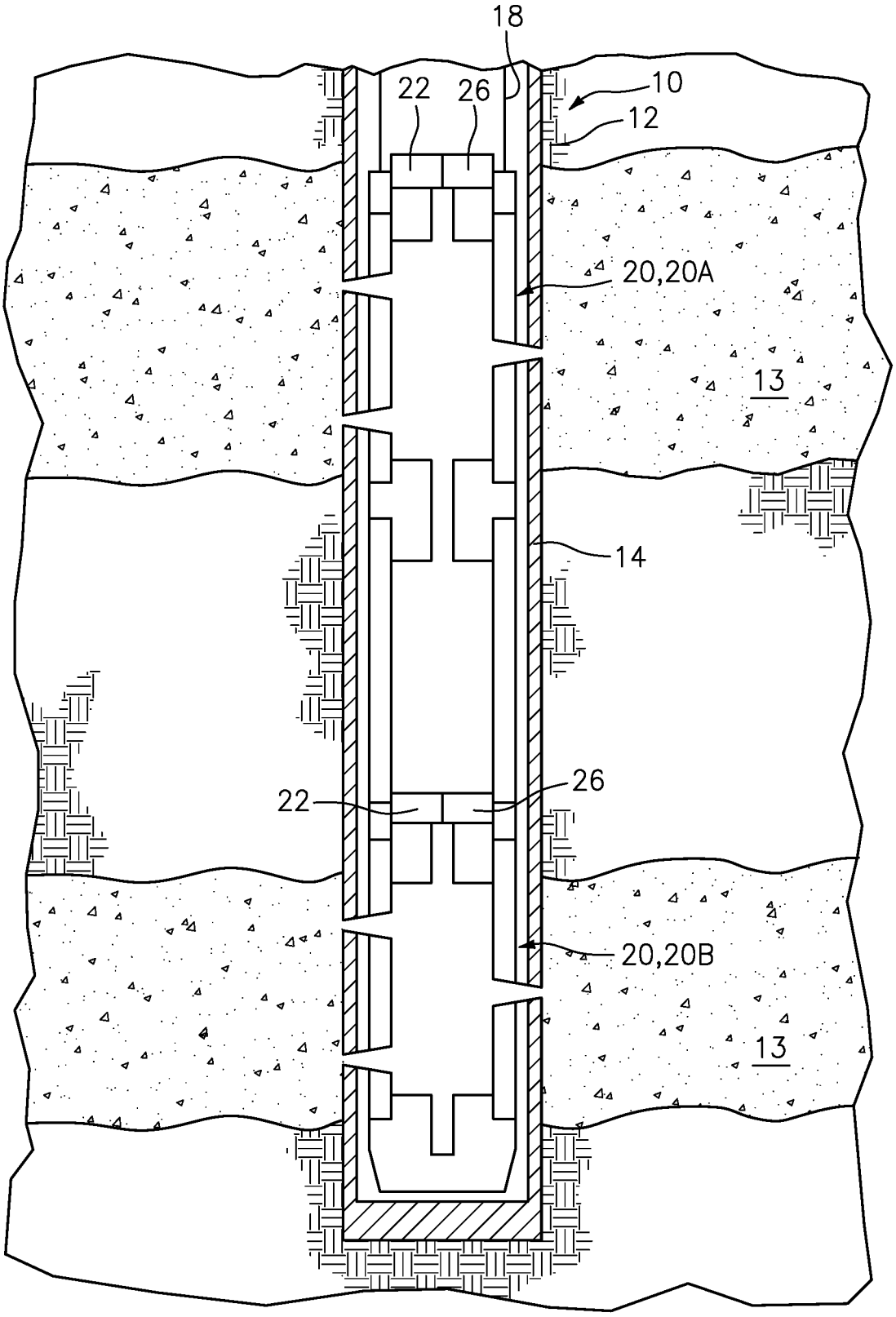
FIG. 3 is a diagrammatic illustration of a portion of a subterranean well, including perforating gun section embodiments, in accordance with one or more aspects of the present disclosure.
Figure 4:
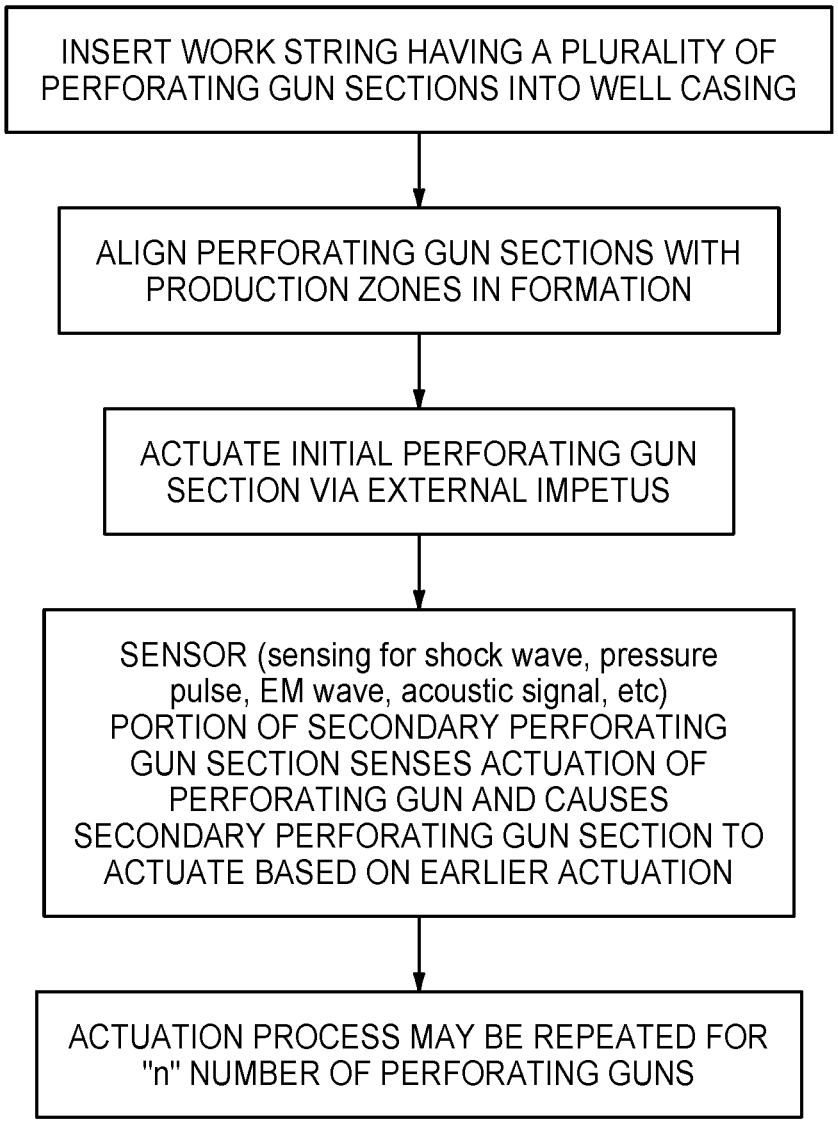
FIG. 4 is a flow chart illustrating operation of an embodiment of the perforating gun system, in accordance with one or more aspects of the present disclosure.

FIG. 3 diagrammatically illustrates a wellbore 10 wherein the perforating gun sections 20A, 20B have been actuated, and the well casing includes perforations that permit fluid travel between respective production zones 13 of the subterranean formation 12 and the interior of the well casing 14.

Work strings 18 according to the present disclosure may assume a variety of different configurations. For example, in some embodiments the perforating gun sections 20 within a work string 18 may have a "top-down" firing sequence, wherein the initial perforating gun section 20A is positioned within the work string 18 so as to be closest to the top of the well casing 14 entry, and the secondary perforating gun sections 20B disposed below the initial perforating gun section 20A. Actuation of the initial perforating gun section 20A causes the secondary perforating gun section 20B closest to the initial perforating gun section 20A to actuate. In turn, actuation of that secondary perforating gun section 20B causes the next in line secondary perforating gun section 20B to actuate, etc. In some embodiments, the perforating gun sections 20 within a work string 18 may have a "bottom-up" firing sequence, wherein the initial perforating gun section 20A is positioned within the work string 18 so as to be farthest from the top of the well casing 14 entry, and the secondary perforating gun sections 10B are disposed above the initial perforating gun section 20A. Here again, actuation of the initial perforating gun section 20A causes the secondary perforating gun section 20B closest to the initial perforating gun section 20A to actuate, and actuation of that secondary perforating gun section 20B causes the next in line secondary perforating gun section 20B to actuate, etc. In some embodiments, the perforating gun sections 20 within a work string 18 may have a predetermined non-sequential firing order. The present disclosure is not limited to any particular perforated gun section 20 firing sequence within a work string 18.

Figure 5:
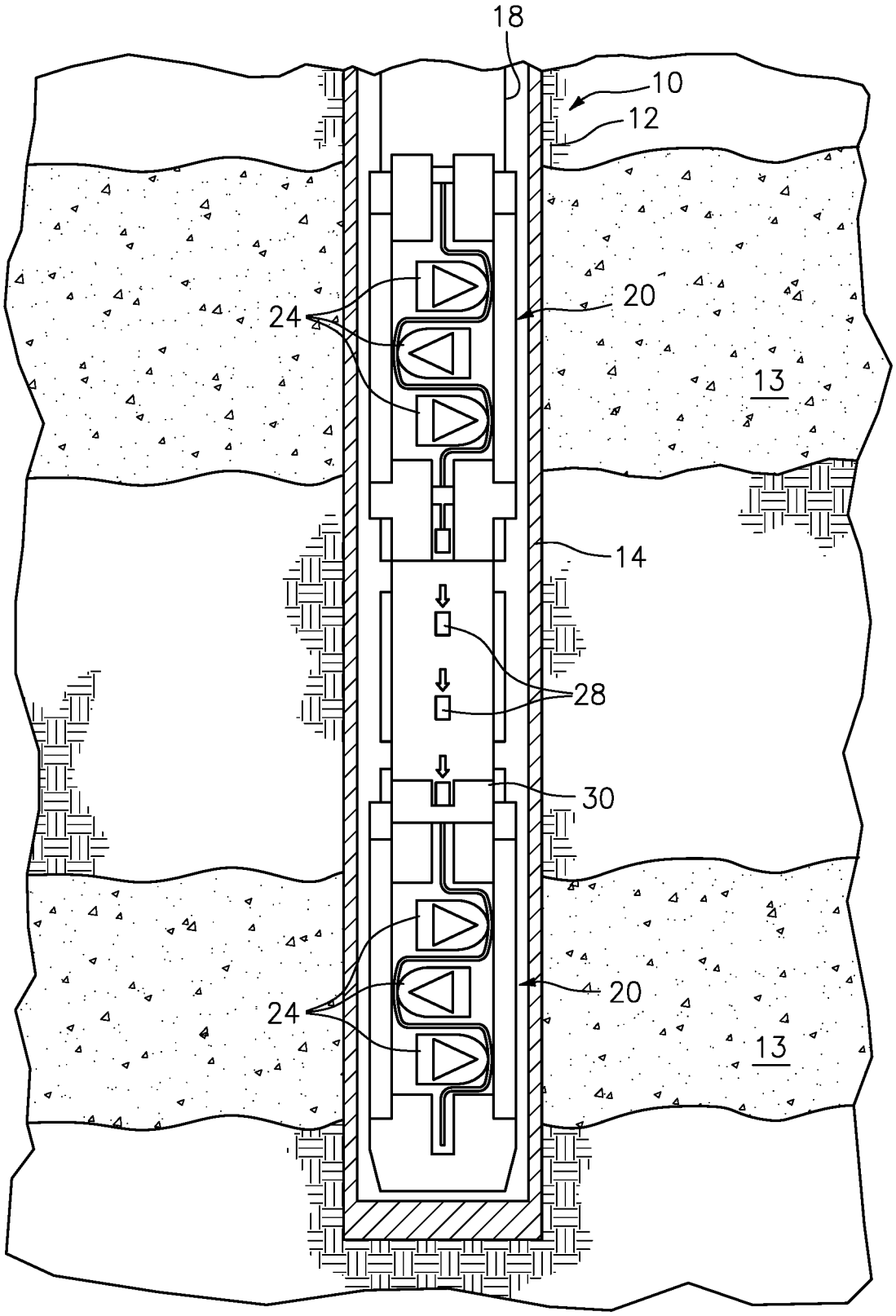
FIG. 5 is a diagrammatic illustration of a portion of a subterranean well, including perforating gun section embodiments, in accordance with one or more aspects of the present disclosure.
Figure 6:
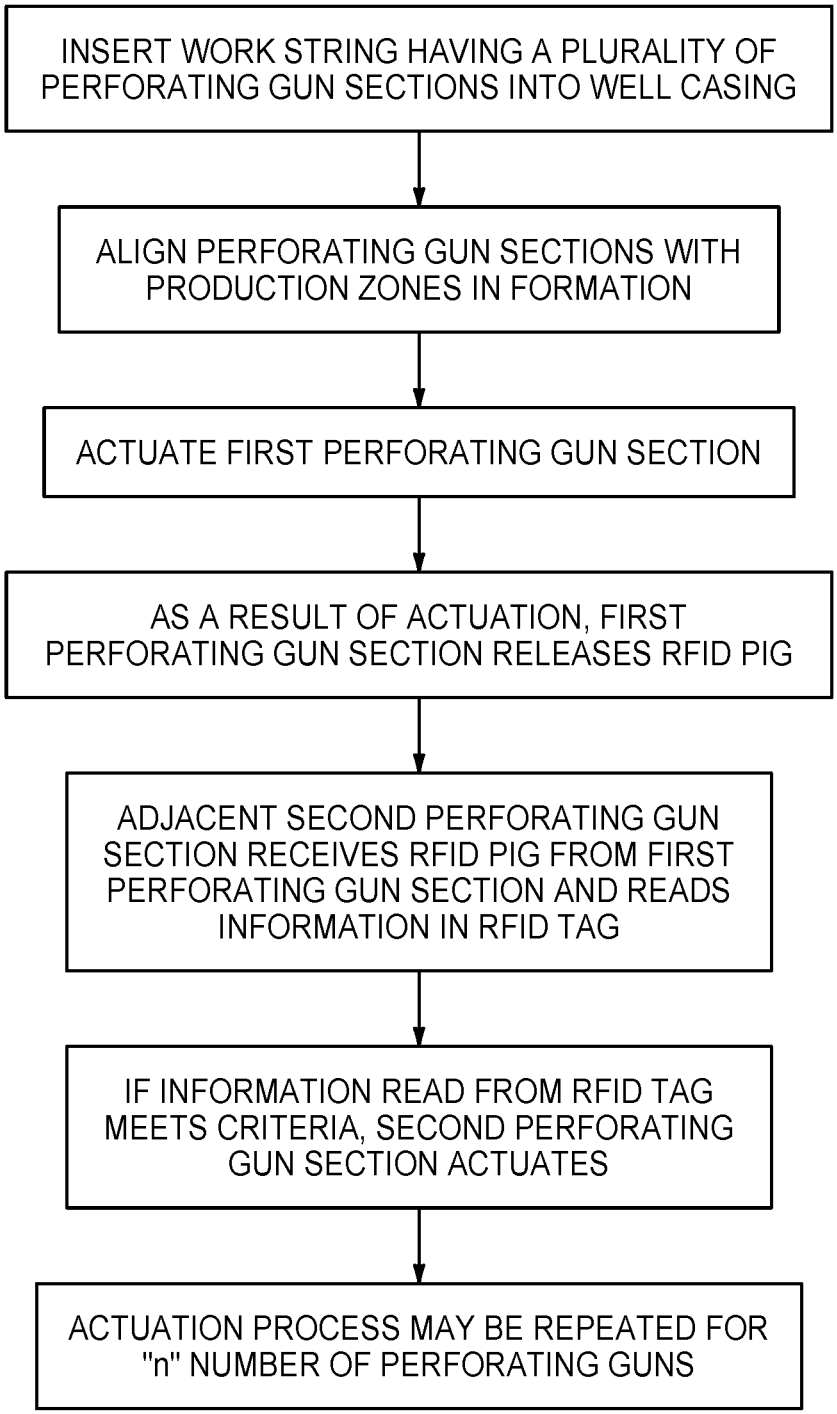
FIG. 6 is a flow chart illustrating operation of an embodiment of the present disclosure.

Referring to FIGS. 1, 5, and 6, in a second embodiment of the present disclosure, a work string 18 may include a plurality of perforating gun sections 20 with non-explosive blank gun sections (i.e., work string 18 sections free of explosive material and/or detonator cord) disposed there between. One or more of the perforating gun sections 20 may be configured with a mechanism for releasing at least one releasable member 28 (a "pig 28") having a radio-frequency identification ("RFID") tag. One or more of the perforating gun sections 20 is configured with at least one RFID reader 30 configured for reading an RFID pig 28. In various embodiments, the RFID reader 30 may be part of the sensor 26. The RFID information available from the RFID tag affixed to the pig 28 is read by the RFID reader 30. In some embodiments, the RFID reader 30 may be a "smart device" configured to interpret the information or may be configured to pass the information to a logic device having the capability to interpret the information. The perforating gun section 20 with the RFID reader 30 is positioned adjacent the perforating gun section 20 configured with at least one RFID tagged pig 28. In some embodiments, the RFID pig 28 may be configured to sink (e.g., see FIG. 5). In these embodiments, the perforating gun section 20 with the RFID reader 30 is positioned adjacent and gravitationally below the perforating gun section 20 configured with at least one RFID pig 28. In some embodiments, the RFID pig 28 may be configured to float. In these embodiments, the perforating gun section 20 with the RFID reader 30 is positioned adjacent and gravitationally above the perforating gun section 20 configured with at least one RFID tagged pig 28.

As described above, some perforating gun sections 20 may include a mechanism for dispensing an RFID pig 28 and other perforating gun sections 20 may include an RFID reader 30. In some embodiments, perforating gun sections 20 may be configured with both a mechanism for dispensing an RFID pig 28 and an RFID reader 30.

In some embodiments having perforating gun sections with at least one RFID tagged pig 28, actuation of the perforating gun section 20 with at least one RFID pig 28 (e.g., detonation of the shaped charges 24) causes the release of the RFID pig 28 (e.g., a "condition" of a perforating gun section actuation). The released RFID pig 28 passes (e.g., sinks down or floats up) through the work string 18 to a perforating gun section 20 with the RFID reader 30. Upon receipt of the RFID pig 28, the perforating gun section 20 with the RFID reader 30 reads the information stored within the RFID tag affixed to the RFID pig 28. If the information matches predetermined criteria, the RFID reader (or a logic device receiving the information from the RFID reader) produces a signal to actuate the perforating gun section 20 with the RFID reader 30. The process of actuation, RFID pig 28 release, RFID reading, and subsequent actuation, can be repeated for a plurality of perforating gun sections 20. As can be seen from the above description, in these embodiments, actuation of a perforating gun section 20 (other than perhaps an initial perforating gun section 20) can only occur upon actuation of a perforating gun section 20.

In some embodiments having perforating gun sections 20 with at least one RFID pig 28, the perforating gun section 20 may include a sensor 26 (as described above) configured to sense the actuation of a perforating gun section 20. In these embodiments, once a signal is sensed by the sensor 26 that meets the predetermined parameter(s), the perforating gun section 20 with at least one RFID pig 28 operates to release the at least one RFID pig 28. The released RFID pig 28 passes (e.g., sinks down or floats up) through the work string 18 to the perforating gun section 20 with the RFID reader 30. Upon receipt of the RFID pig 28, the perforating gun section 20 with the RFID reader 30 reads the RFID pig 28 (as described above) and produces a signal to actuate the perforating gun section 20 with the RFID reader 30. Here again, the process of sensing, RFID pig 28 release, RFID reading, and subsequent actuation, can be repeated for a plurality of perforating gun sections 20. As indicated above, in these embodiments, actuation of a perforating gun section 20 can only occur upon actuation of a perforating gun section 20.

As stated above, prior art perforating gun assemblies that utilize blank gun sections configured with explosive boosters at both ends and explosive detonating cord there between, potentially have operational issues; e.g., stop-fires, substantial costs, etc. Other prior art perforating gun assemblies that utilize standard API tubing or drill pipe between loaded intervals, instead of blank guns, require each perforating gun section to have discreet firing heads. Depending on the type of firing head, these can be more expensive than utilizing blank gun sections and each has its own risk profile. The present disclosure overcomes these issues and provides a substantial improvement over the known prior art.

It is noted that various connections are set forth between elements in the following description and in the drawings (the contents of which are included in this disclosure by way of reference). It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities or a space/gap between the entities that are being coupled to one another.

Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A perforating gun system for use in a well casing disposed within a subterranean well, the perforating gun system comprising:

a plurality of perforating gun sections, each having at least one shaped charge, the plurality of perforating gun sections including:

an initial perforating gun section; and at least one secondary perforating gun section having an activator and a sensor configured to sense an actuation of another of the plurality of perforating gun sections, the sensor further configured to cooperate with the activator to actuate the at least one secondary perforating gun section upon sensing the actuation of the another of the plurality of perforating gun sections wherein the sensor configured to sense the actuation of the another of the plurality of perforating gun sections is further configured to sense for at least one of a shock wave, a pressure pulse, an EM wave, or an acoustic signal directly produced by the actuation of the another of the plurality of perforating gun sections.

2. The system of claim 1, wherein the initial perforating gun section is configured to be actuated via an external impetus.

3. The system of claim 1, wherein the at least one secondary perforating gun section includes a time delay mechanism within a signal path between the sensor and the activator and configured to delay the actuation of the at least one secondary perforating gun section.

4. The system of claim 1, wherein the initial perforating gun section is configured to produce an identifier upon actuation which is unique to the initial perforating gun section.

5. The system of claim 4, wherein the at least one secondary perforating gun section comprises a first secondary perforating gun section and the first secondary perforating gun section is configured to actuate upon receipt of the unique identifier of the initial perforating gun section.

6. The system of claim 5, wherein the first secondary perforating gun section is configured to produce a second identifier upon actuation which is unique to the first secondary perforating gun section and different than the unique identifier of the initial perforating gun section and wherein the at least one secondary perforating gun section further comprises a second secondary perforating gun section and the second secondary perforating gun section is configured to actuate upon receipt of the unique second identifier of the first secondary perforating gun section.

7. The system of claim 1, wherein the at least one secondary perforating gun section is configured to count a number of perforating gun section actuations and to actuate when the counted number of perforating gun section actuations equals a predetermined number of perforating gun section actuations.

8. A perforating gun system for use in a well casing disposed within a subterranean well, the perforating gun system comprising:

a plurality of perforating gun sections, each having at least one shaped charge, the plurality of perforating gun sections including:

a first perforating gun section having at least one RFID pig and an RFID pig release mechanism, the RFID pig release mechanism configured to release the at least one RFID pig upon actuation of the first perforating gun section; and at least one secondary perforating gun section having an activator and an RFID reader, the RFID reader configured to read information from the at least one RFID pig, the RFID reader further configured to cooperate with the activator to actuate the secondary perforating gun section upon reading the information from the at least one RFID pig.

9. The system of claim 8, wherein the plurality of perforating gun sections are configured such that the at least one secondary perforating gun section is located gravitationally adjacent the first perforating gun section.

10. The system of claim 9, wherein the at least one RFID pig is configured to float within a fluid of the subterranean well.

11. The system of claim 9, wherein the at least one RFID pig is configured to sink within a fluid of the subterranean well.

12. The system of claim 8, wherein the at least one secondary perforating gun section comprises at least one secondary RFID pig and a secondary RFID pig release mechanism configured to release the at least one secondary RFID pig.

13. The system of claim 12, wherein the secondary RFID pig release mechanism is configured to release the at least one secondary RFID pig upon actuation of the at least one secondary perforating gun section.

14. The system of claim 8, wherein the first perforating gun section further comprises a sensor configured to sense an actuation of another of the plurality of perforating gun sections, the sensor further configured to cooperate with the RFID pig release mechanism to cause the RFID pig release mechanism to release the at least one RFID pig upon actuation of the another of the plurality of perforating gun sections.

15. A method for actuating a plurality of perforating gun sections of a perforating gun system for a subterranean well, the method comprising:

inserting a work string having a plurality of perforating gun sections, each having at least one shaped charge, into a well casing disposed within the subterranean well, the plurality of perforating gun sections comprising a first perforating gun section and at least one secondary perforating gun section having an activator and a sensor;

aligning the plurality of perforating gun sections with a respective plurality of production zones within the subterranean well; and actuating the plurality of perforating gun sections by actuating the first perforating gun section via external impetus such that a condition caused by actuation of the first perforating gun section is sensed by the sensor causing the activator to actuate the at least one secondary perforating gun section, wherein actuating the initial perforating gun section includes:

releasing at least one RFID pig with an RFID pig release mechanism of the first perforating gun section upon actuation of the first perforating gun section; and reading information from the at least one RFID pig with an RFID reader of the at least one secondary perforating gun section and actuating the at least one secondary perforating gun section upon reading the information from the at least one RFID pig, wherein the sensor of the at least one secondary perforating gun section comprises the RFID reader.

16. The method of claim 15, wherein actuating the plurality of perforating gun sections includes sensing an actuation of another of the plurality of perforating gun sections, with the sensor, and actuating the at least one secondary perforating gun section upon sensing the actuation of the another of the plurality of perforating gun sections.

17. The method of claim 15, wherein the plurality of perforating gun sections of the work string has one of a top-down firing sequence or a bottom-up firing sequence.

* * * * *